United States Patent [19]

Jones

[11] Patent Number: 4,494,615

[45] Date of Patent: Jan. 22, 1985

[54] JARRING TOOL

[75] Inventor: Kenneth R. Jones, Corpus Christi, Tex.

[73] Assignee: Mustang Tripsaver, Inc., Corpus Christi, Tex.

[21] Appl. No.: 314,466

[22] Filed: Oct. 23, 1981

[51] Int. Cl.[3] ..... B25D 9/00; E21B 4/00

[52] U.S. Cl. ..... 173/119; 173/29; 175/299; 175/321

[58] Field of Search ..... 173/119, 120, 121, 29; 175/299, 300, 302, 304, 321

[56] References Cited

U.S. PATENT DOCUMENTS

| | | | |
|---|---|---|---|
| 1,801,673 | 4/1931 | Knox | 175/304 |
| 2,122,751 | 7/1938 | Phipps | 175/300 |
| 2,733,046 | 1/1956 | Thompson | 175/303 X |
| 3,343,606 | 9/1967 | Dollison | 175/299 |
| 3,724,568 | 4/1973 | Koepke | 175/247 |
| 3,834,471 | 9/1974 | Bottoms | 175/304 |
| 4,333,542 | 6/1982 | Taylor | 175/302 |

OTHER PUBLICATIONS

Brochure of "Taylor Made Oil Tools Company".

"Journal of Petroleum Technology", Nov. 19, 1979, pp. 1381–1386.

*Primary Examiner*—E. R. Kazenske

*Assistant Examiner*—Willmon Fridie, Jr.

*Attorney, Agent, or Firm*—G. Turner Moller

[57] ABSTRACT

An oil field jar includes a barrel and mandrel selectively interconnected by a ball transfer mechanism so that pulling upwardly on the jar causes a ring spring assembly to be stressed. As the spring assembly reaches its limit of stroke, the ball transfer mechanism trips so that the mandrel moves relatively freely with respect to the barrel. A hammer and an anvil carried by the mandrel and barrel then impact to create an upwardly directed jar on the fish to which the tool of this invention is connected. The ball transfer mechanism includes a plurality of balls which move both axially and radially of the tool during operation.

3 Claims, 7 Drawing Figures

FIG. 1b
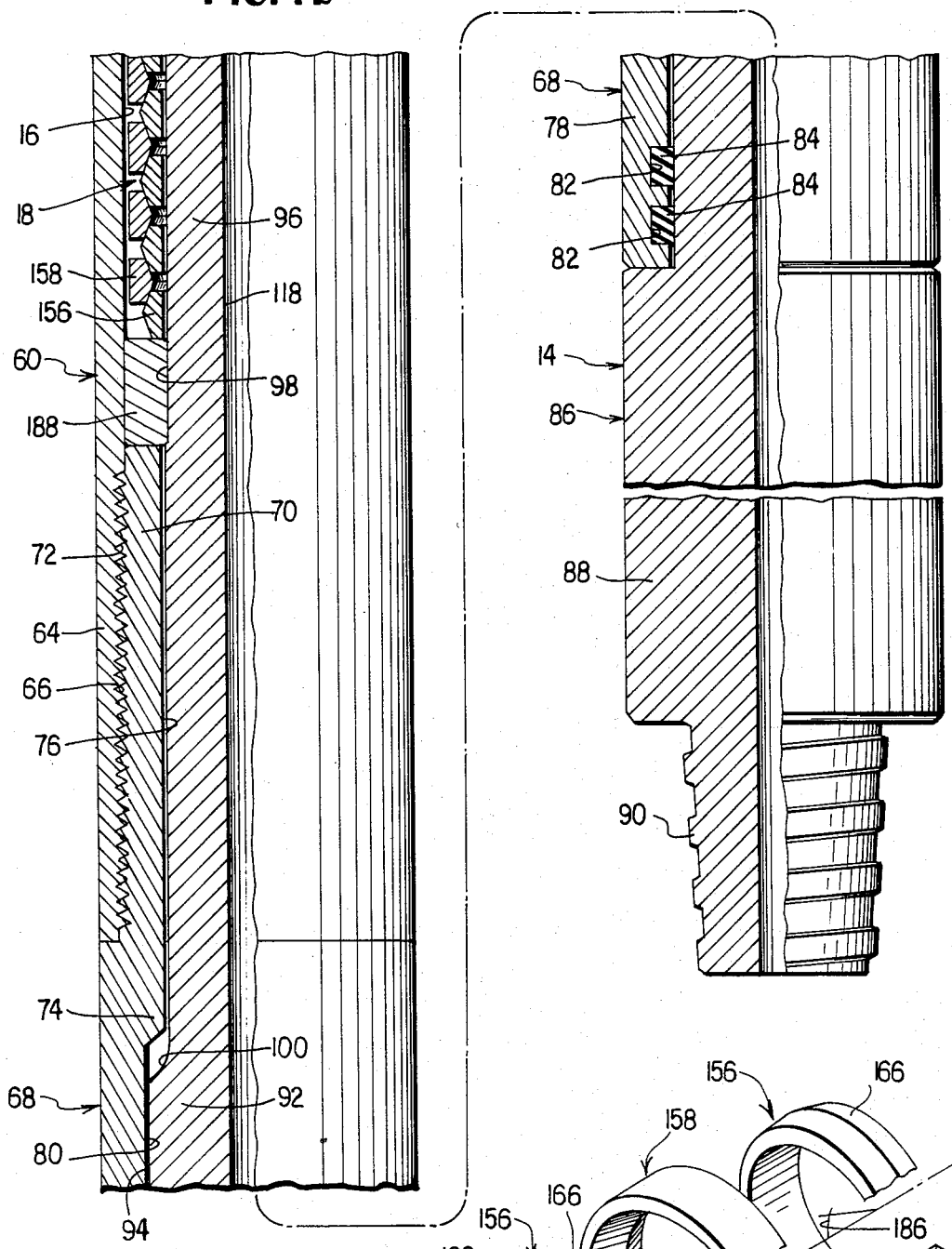
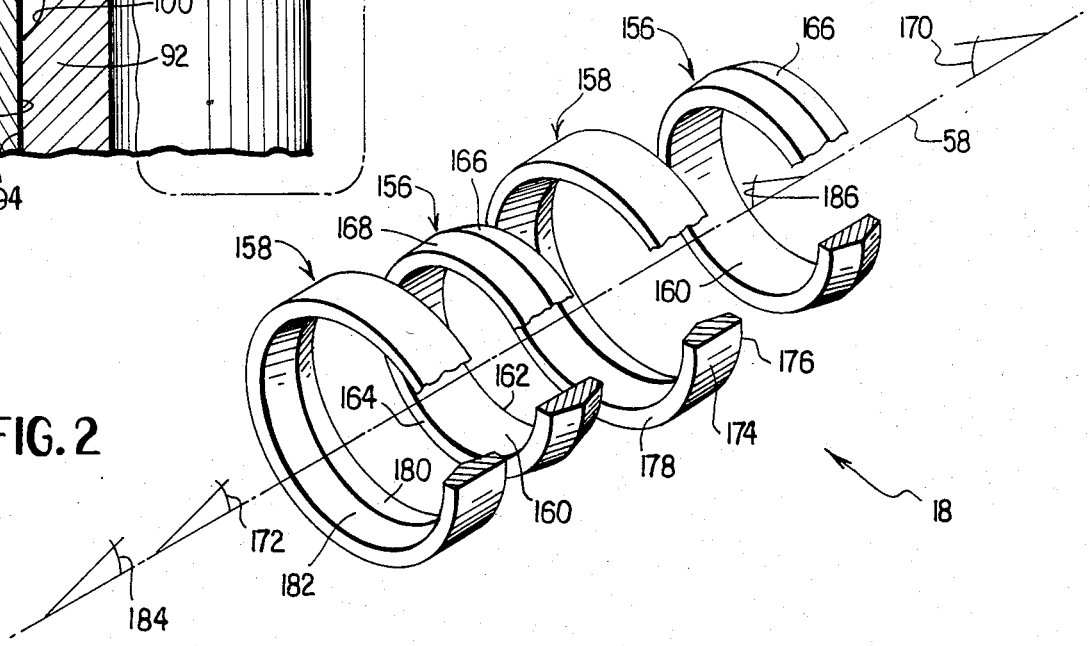
FIG. 2

JARRING TOOL

This invention relates to oil field jars which are those devices typically used in the attempt to remove a stuck object, known as a fish, from a well bore. Jars operate by creating an impact, usually upwardly directed, on the fish.

The design and operation of oil field jars is rather well developed. An exemplary discussion of the mechanics of jarring is found in an article entitled "Drill String Dynamics During Jar Operation", Journal of Petroleum Technology, November 1979, pages 1381–1386.

Broadly, there are two types of jars: fishing jars and drilling jars. A fishing jar is run into a well bore only when an attempt is to be made to remove a fish. A drilling jar is run into a well bore on a drilling string, including a bit and possibly one or more drill collars, during a normal drilling operation long before any sticking has occured. The drilling jar has no function until and unless part of the drill string becomes stuck. Because a drilling jar must be capable of withstanding the rigors of drilling, drilling jars are normally considered more robust than fishing jars. When actually in use, fishing jars operate on the same principle as drilling jars. The jar of this invention may be employed as either a fishing or drilling jar.

Jars may also be characterized as either of the fluid or mechanical type. Broadly, mechanical jars comprise a barrel, a mandrel telescopinglt received in the barrel, a spring assembly stressed during separating or untelescoping movement between the mandrel and barrel, a hammer and anvil carried by the barrel and mandrel, and a trip mechanism which operates, during initial pulling movement on either the barrel or mandrel, to compress the spring and which ultimately releases the mandrel and barrel for rapid relative movement. When the trip mechanism releases, rapid movement of the hammer toward the anvil creates an upward impact force on the fish. Broadly, it is this type device with which this invention is most nearly related.

In operation, a conventional mechanical jar is operated by pulling upwardly on the fishing string. When a predetermined tension value is applied to the jar, the trip mechanism releases the connection between the mandrel and spring. Because a sizable amount of tension has been imparted to the fishing string, the barrel moves upwardly at a fairly rapid rate relative to the mandrel. As the barrel approaches the end of its stroke, a hammer carried thereby strikes an anvil on the mandrel to create the upward impact or jar on the fish to which the mandrel is connected by a conventional grapple, such as a spear or overshot. Mechanical jars of this description are old and well known in the art for use either as fishing or drilling jars.

One of the disadvantages of current popularly available fishing and drilling jars is that they are excessively long. Commonly sized drilling jars and many fishing jars are on the order of 25 feet long. Such jars accordingly require a full size trailer and tractor rig to transport them to a well site. As will be more fully explained hereinafter, jars of this invention are on the order of 6–8 feet in length in large diameter tools and somewhat shorter in smaller diameter models, such as for use on sucker rods. It is manifestly simple to transport such tools in the bed of a conventional pickup truck. In addition, considerable downhole advantages accrue during use of short drilling and fishing jars. In a tool of given external diameter and given internal diameter, shorter tools, in accordance with this invention, exhibit considerably better torisional stability which is manifestly desirable in drilling jars. Taking drilling jars as exemplary, it will be evident that the external diameter of a jar is dictated by the size hole, size drill pipe and other factors beyond the control of the drilling jar manufacturer. Similarly, the internal diameter of a particular tool should be as large as possible to allow circulation of drilling fluid therethrough. Consequently, the drilling jar designer is presented with certain limits which, in very long tools, precludes the development of torsionally staff jars.

Another advantage of short jars as opposed to long jars lies in their ability to be racked in the derrick without the use of pup joints or the like. In a treble rig, the monkey board is placed from the floor on the order of 85 feet to accomodate three 30 foot long joints which extend about 5 feet above the monkey board when racked. It will be evident, for example, that a 25 foot long jar coupled with two 30 foot fishing string joints is just barely above the monkey board. To prevent such a stand from slipping out of the monkey board, a pump joint on the order of 3 feet long or so is connected to the stand.

It will be evident that a short jar, in accordance with this invention, may be handled as part of a three joint stand of about 96–98 feet in length. Since the conventional treble rig can rack a stand of this length in the monkey board, no pup joint is required. Consequently, the jar of this invention may be removed from the well bore without slowing down to place a pup joint in the stand. Similarly, a stand incorporating the jar of this invention can be run into the well bore without stopping to remove the pup joint. More importantly, one does not have to remember to remove the pup joint and the possibility of running the pup joint into the hole is eliminated.

It is an object of this invention to provide a relatively short oil field jar incorporating an improved ball transfer tip mechanism.

Another object of this invention is to provide an improved oil field jar incorporating a ring spring assembly.

Other objects and advantages of this invention will become more fully apparent as this description proceeds, reference being made to the accompanying drawings and appended claims.

IN THE DRAWINGS

FIGS. 1*a* and 1*b* are a longitudinal sectional view of a jar of thisinvention, illustrating the device in a position of rest;

FIG. 2 is a partial broken isometric view of the spring assembly of this invention;

Figure 1A:
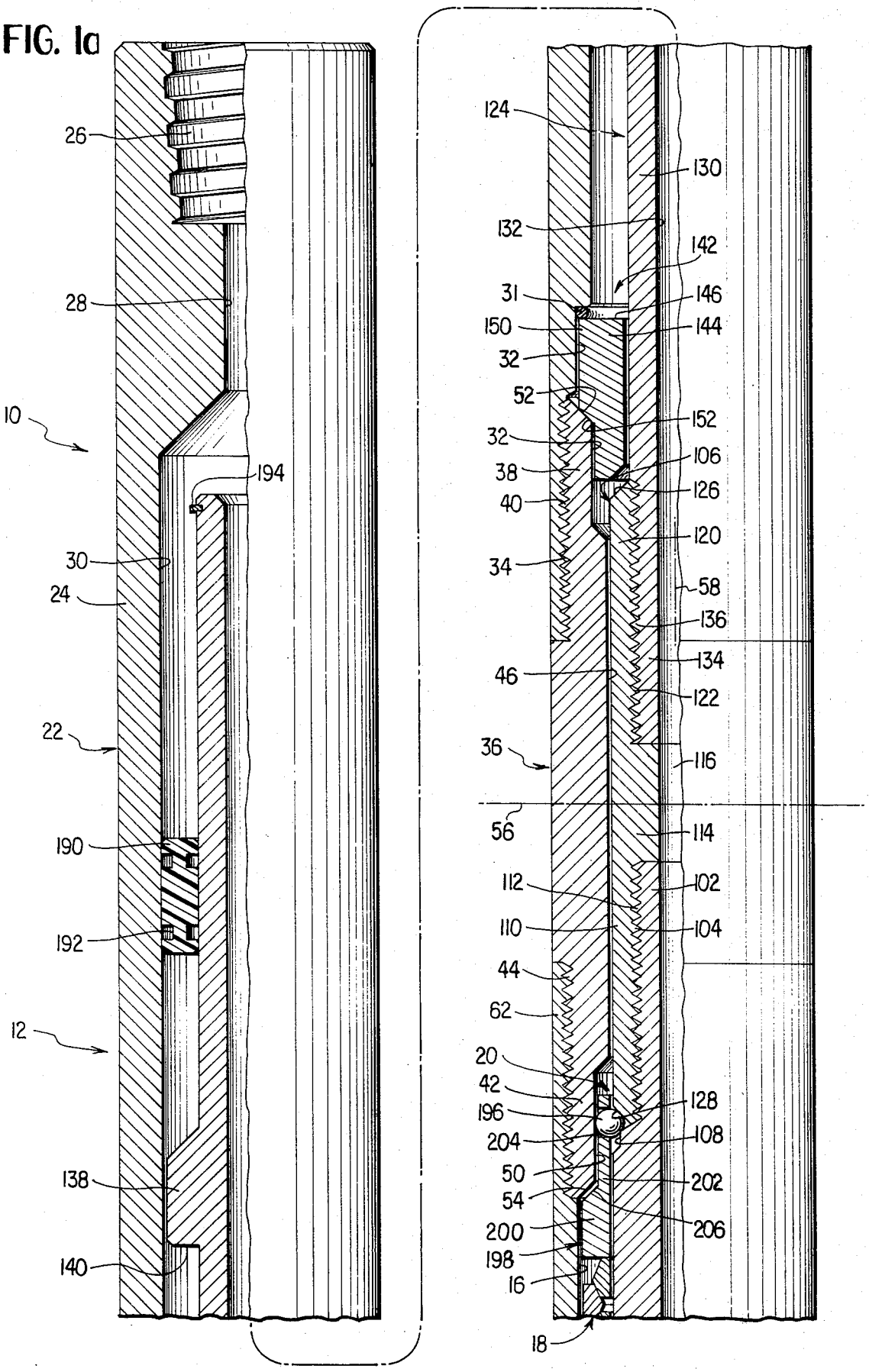

Referring to the drawings, there is illustrated a jar 10 of this invention comprising, as major components, a barrel 12 telescopingly receiving a mandrel 14 and defining therebetween a spring chamber 16 having therein a spring assembly 18, and a ball transfer trip mechanism 20. Although the jar 10 of this invention is operative with either the barrel up or the barrel down, it will be illustrated and described with the barrel 12 being connected to a drill string (not shown) extending through the bore hole to the surface for manipulatin by a conventional drilling or workover rig. The barrel 14 will be described as connected to a grappling mechanism, in the case of a fishing jar, such as a spear or overshot. If the jar 10 were used in a drill string as a drill jar, the mandrel 14 would be connected in the drill collar string on the bottom of which is a bit.

The barrel 12 includes an upper body 22 comprising a piece of tubular stock 24 having coarse female threads 26 at the upper end thereof for connection to the drilling or fishing string. A passage 28 of restricted diameter enlarges to a passage 30 of increased diameter. A shoulder 31 enlarges the passage 30 into a section 32 of yet larger diameter. The lower end of the upper body 22 terminates in relatively fine female threads 34.

The barrel 12 also includes a connecting section 36 having an upper end 38 providing male threads 40 threadably engaged with the threads 34 and a substantially identical lower section 42 providing substantially identical male threads 44. The connecting section 36 includes a central passage 46 of somewhat smaller diameter than the passage 30 and a pair of passage sections 48, 50 of substantially the same diameter as the passage 30. The passage sections 48, 50 terminate in a pair of frustoconical surfaces 52, 54.

As will be more fully pointed out hereinafter, the surface 54 comprises a wear surface of the ball transfer trip mechanism 20. The connecting section is preferably designed to be symmetrical about a plane 56 which is perpendicular to the centerline 58 of the tool 10. It will accordingly be evident that when the wear surface 54 has been eroded to an extent that function of the jar 10 is impaired, the connecting section 36 may be removed, reversed and reinstalled to present the surface 52 adjacent the ball transfer trip mechanism 20 thereby providing a new wear surface. Thus, the wear surfaces 52, 54 are symmetrical about the plane 56. It will be seen that the reversal of the wear surfaces 52, 54 may be accomplished in the field so that the jar 10 may be renewed without taking it to a shop.

The barrel 12 also comprises a lower body 60 having an upper end 62 providing female threads engaging the threads 44 and a lower end 64 providing female threads 66. The internal diameter of the lower body 60 comprises part of the spring chamber 16.

Threadably engaged on the lower end of the lower body 60 is a spline and seal section or body 68 having an upper end 70 providing male threads 72 engaged with the threads 66. The upper end 70 also comprises a plurality of ribs or splines 74 which mesh with comparable grooves in the mandrel 14 to provide a torque transmitting connection between the barrel 12 and mandrel 14. The upper end 70 provides a central unobstructed passage 76 between the splines 74. Accordingly, the jar 10 ia usable either as a fishing or drilling jar. In the case of some types of fishing jars, there is no requirement for a torque transmitting connection and the splines 74 on the spline and seal body 68 may be eliminated.

The lower end 78 of the spline and seal body 68 provides a central passage 80 having a pair of circular slots or recesses 82 opening thereinto for receiving seal assemblies 84 to provide a fluid seal between the lower ends of the barrel 12 and mandrel 14.

The mandrel 14 comprises a lower body 86 having a lowermost section 88 providing an external diameter substantially the same as the barrel 12 and includes relatively coarse threads 90 on the lower end thereof for connection to a grappling device, in the case of a fishing jar, or a drill collar string in the case of a drilling jar.

The mandrel lower body 86 also includes an intermediate section 92 having an external surface 94 of slightly less diameter than the passage 80 and an upper section 96 having a cylindrical external surface 98 interrupted by spline recesses 100 on the lower end thereof for receiving the splines 74 of the barrel 12. The upper end 102 of the mandrel lower body 86 terminates in male threads 104 for securement to a mandrel connecting section 106. Adjacent the juncture of the threads 104 with the cylindrical external surface 98, there is provided a rim 108 of reduced external diameter which cooperates with the ball transfer mechanism 20 as more fully pointed out hereinafter The connecting section 106 basically comprises a collar having a lower end 110 providing female threads 112 for securement to the male threads 104 of the upper mandrel end 102. The threads 112 terminate in a shoulder 114 providing a passageway 116 which is preferably of the same diameter as a passage 118 extending through the mandrel lower body 86. The connecting section 106 also includes an upper end 120 having female threads 122 for securement to a mandrel upper body 124. The upper and lower ends 120, 110 of the connecting section 106 provide a frustoconical wear surface 126, 128 for cooperation with the ball transfer mechanism 20 as more fully explained hereinafter. It will thus be seen that the rim 108 of reduced diameter and the wear surface 128 cooperate to provide a circular notch in the periphery of the mandrel 14. As will be more fully apparent hereinafter, the ball transfer mechanism 20 uses this notch for latching the mandrel 14 to the spring assembly 18.

As illustrated, only one of the wear surfaces 126, 128 is in operative relation with the ball transfer mechanism 20 at any one time. It will be noted that the connecting mechanism 106 is symmetrical about the plane 56. Consequently, when wear occurs on the surface 128 to the extent that operation of the ball transfer mechanism 20 deteriorates, the jar 10 may be disassembled in the field to invert or reverse the connecting section 106 to present a new wear surface 126 to the ball transfer mechanism 20.

The mandrel upper body 124 comprises an elongate tubular section 130 having a central passage 132 therethrough communicating with the passages 116, 118 to provide a fluid path through the interior of the jar 10. It will thus be evident that drilling or completion fluids may be circulated through the jar 10 as may be required during conventional fishing operations. The upper mandrel body 124 includes a lower section 134 having male threads 136 thereon for securement to the female threads 122 of the connecting section 106.

Integral with the tubular section 130 is an impact member 138 having a face 140 perpendicular to the tool axis 58. As will be more fully apparent hereinafter, the impact member 138 impacts against another impact member 142 carried by the barrel 12. Since the jar 10 is being described as if the mandrel 14 is connected to the fish, the impact member 138 is relatively stationary and the impact member 142 is relatively movable. Accordingly, the impact member 138 is called the anvil and the impact member 142 is called the hammer. It will be evident, of course, that the terms hammer and anvil are interchangable.

Although the hammer 142 may be fixed or rigid with the barrel 12, the hammer 142 preferably comprises a component which is constrained for movement with the barrel 12 but which can be removed by disassembling the barrel upper body 22 from the connecting section 36 and by disassembling the mandrel upper body 124 from the connecting section 106. To this end, the hammer 142 comprises a body 144 having an impact face 146 parallel to the face 140 of the anvil 138. The body 144 is generally of annular construction having a central passage 148 receiving the tubular section 130 of the mandrel upper body 124. The hammer body 144 also includes an upper section 150 of somewhat larger external diameter to be closedly received in the enlarged passage section 32 of the barrel upper body 22. The body 144 provides a frustoconical wear surface 152 abutting the wear surface 52 of the connnecting means 36. A rubber O-ring 154 is positioned between the face 146 and the shoulder 31 to captivate the hammer body 144 to the barrel 12.

As will be seen, the spring chamber 16 is located between the barrel lower body 60 and the upper section 96 of the mandrel lower body 86. The spring assembly 18 in the chamber 16 has a number of important functions during operation of the jar 10. Its primary function, however, is to allow tensioning of the fishing string attached to the barrel 12 so that energy can be stored in the fishing string prior to release of the ball transfer mechanism 20. As will be evident to those skilled in the art, the magnitude of the impact between the hammer 142 and anvil 138 depends largely upon the load capacity of the spring assembly 18. The load capacity of any spring assembly may be stated to be:

$$F=S_r(D)$$

where F is the load capacity of a spring having a spring rate $S_r$ subject to a movement of displacement D. The spring rate $S_r$ of most springs is not a constant although it is often so assumed. However, by judiciously selecting the amount of preload applied to a spring and by limiting the displacement D to a rather small quantity, the spring rate $S_r$ of most springs are approximately constant.

One important criteria for spring selection for oil field jars is that it is highly desirable to have the capability of adjusting the force required to trip the release mechanism. As applied to the jar 10 of this invention, it is highly desirable to have the capability of manipulating the spring assembly 18 to alter the tensile force applied to the barrel 12 to trip the ball transfer mechanism 20. It will be evident, of course, that the magnitude of the impact forces generated between the hammer 142 and anvil 138 become greater when the tensile force applied to the barrel 12 becomes larger. It might be thought, at first blush, that one could design a tool having a predetermined maximum load capacity in the spring assembly 18 and be done with it. This would, of course, produce a jar having an impact of maximum predetermined amount. Such would not be desirable since the fish being pulled on may be unable to withstand the maximum impact forces generated by such a jar. For example, the same jar might be used to fish for $2\frac{7}{8}$", N-80 externally upset tubing and for 2" Hydril tubing. Since the tensile strength of the latter is substantially below the tensile strength of the former, it will be evident that a jar designed to produce a maximum unadjustable impact will be mismatched against one or both of the strings being pulled on.

Not only does the ring spring assembly 18 of this invention meet these criteria, but it also provides an important additional advantage in that the spring necessary to provide the desired load capacity is very short thus contributing a minimum amount to the overall length of the jar 10. The ring spring assembly 18 is a major reason why the jar 10 of this invention is very short. In addition, the spring rate $S_r$ of the ring spring assembly 18 is very nearly linear throughout the range of movement of the spring thereby enabling extremely straight forward load adjustments.

Referring to FIGS. 1 and 2, the ring spring assembly 18 includes a plurality of inner annular ring springs 156 and a plurality of outer annular ring springs 158. The ring springs 156, 158 are alternately stacked in the chamber 16 provided between the barrel 12 and mandrel 14. Upward pulling on the barrel 12 causes each of the springs 156, 158 to be stressed substantially only in a plane perpendicular to the tool axis 58. When stressed, the inner ring springs 156 are placed in compression while the outer ring springs 158 are placed in tension.

All of the inner ring springs 156 are desirably identical. Although the cross sectional shape of the ring springs 136 may vary substantially as pointed out in Characteristics of Ring Springs by Tyler G. Hicks, American Machinist, 1928, pages 192–195 and Mechanical Springs, First Edition, Arthur M. Wahl, Penton Publishing Company, 1944, pages 348–358., the inner ring springs 156 preferably comprise a radially inner cylindrical surface 160. The inner diameter of the surface 160, in either the unstressed or fully stressed condition of the springs 156, is larger than the diameter of the surface 98 of the mandrel 14.

The inner ring springs 156 also include upper and lower surfaces 162, 164 which are generally transverse to the tool axis 58 and which are preferably perpendicular thereto. The radially outer surface of the inner springs 156 includes a pair of surfaces 166, 168 which are frustoconical in configuration and which include a common maximum diameter. The surfaces 166, 168 define oppositely facing acute angles 170, 172 respectively with the tool axis 58. As will be more fully apparent hereinafter, the angles 170, 172 are preferably identical.

The outer ring springs 158 are also desirably identical. Although the outer ring springs 158 may also be of any suitable shape, in order to maximize the cross sectional area in a plane including the tool axis 58, the ring springs 158 include a radially outer cylindrical surface 174. The diameter of the radially outer surface 174 is less, in either the unstressed or fully stressed condition of the spring assembly 18, than the diameter of the passage provided by the barrel body 60.

The outer ring springs 158 also include upper and lower surfaces 176, 178 which are transverse to the tool axis 58 and which are preferably perpendicular thereto. The radially inner surface of the outer ring springs 158 include a pair of surfaces 180, 182 which are frustoconical in configuration and which include a common minimum diameter. The surfaces 180, 182 define oppositely facing acute angles 184, 186 with the tool axis 58.

If the angles 170, 172, 184, 186 are substantially identical, this will allow all of the inner ring springs 156 to be identical and all of the outer ring springs 158 to be identical. This is, of course, highly desirable when it is necessary to replace any of the springs 156, 158. In addition, this provides considerable simplicity in design and manufacture of the jar 10.

The design selection of the quantity of the angles 170, 172, 184, 186 is of substantial importance. Reference is made to U.S. Pat. No. 4,254,837, the disclosure of which is incorporated herein by reference, for a more complete description thereof.

One of the oddities of ring springs lies in the relationship between the number of springs and the spring rate of the assembly. Because the load applied to the spring assembly 18 by lifting on the barrel 12 is transmitted through each of the ring springs 156, 158, it will be seen that each spring is subjected to the entire applied load. Accordingly, $$S_{ra} = \text{Load}/D_s(n)$$

where $S_{ra}$ is the spring rate of the assembly 18, $D_s$ is the deflection of each individual spring and n is the number of springs 156, 158.

Figure 5:
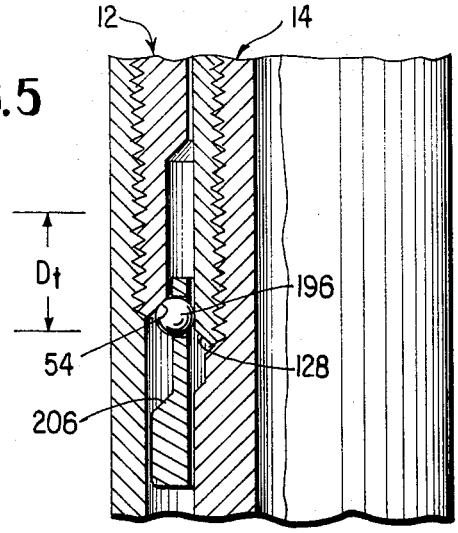
FIG. 5 is a view similar to FIGS. 3 and 4 illustrating the trip mechanism at the instant of release of the barrel relative to the mandrel.
Figure 6:
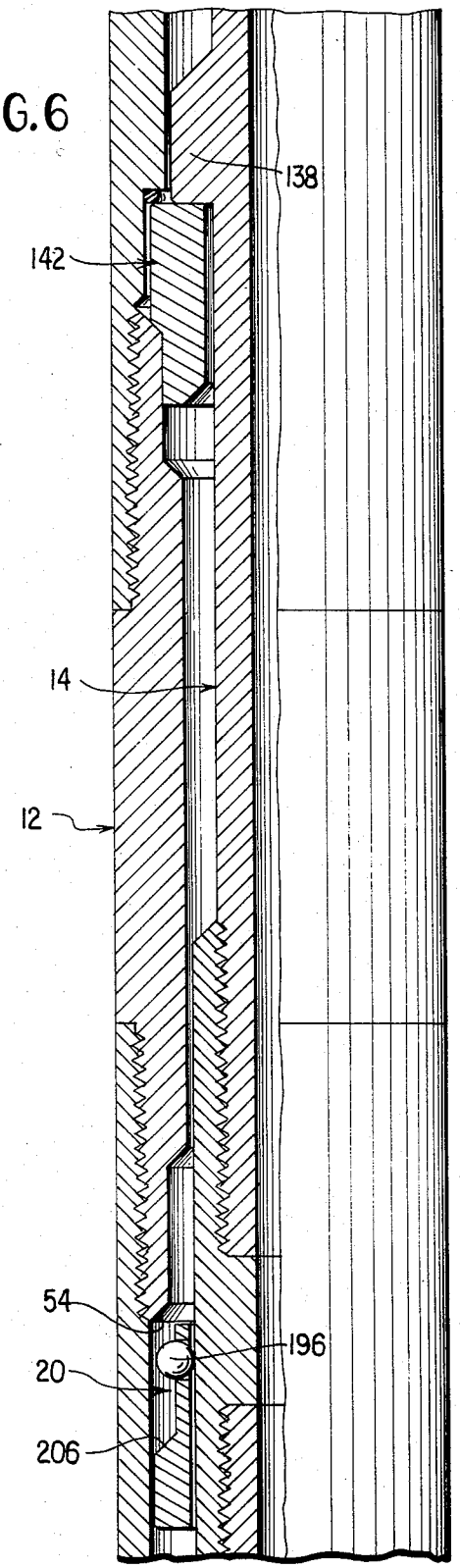
FIG. 6 is a partial sectional view of the tool of this invention illustrating the device at the time of impact of the hammer and anvil.

In the jar 10, the ball transfer mechanism 20 trips, as more fully explained hereinafter, when the barrel 12 moves upwardly from the position shown in FIG. 1 to the position shown in FIG. 5. This amounts to a total deflection $D_t$ accomodated by the spring assembly 18. The total deflection $D_t$ will be seen to be the cumulative amount of deflection of each spring or $D_s(n)$. Accordingly, the only way to change the load required to obtain the total deflection $D_t$ in order to trip the ball transfer mechanism 20 is to change the spring rate of the assembly 18.

Fortunately, the spring rate of the ring spring assembly 18 may be modified merely by changing the number of springs in the assembly. To this end, FIG. 1 illustrates an annular spacer 188 of rectangular cross section positioned between the upper end 70 of the spline and seal body 68 and the lowermost spring of the assembly 18. It will be evident that the spring assembly 18 is designed to normally incorporate a spacer 188 so that the spring rate of the assembly 18 may be decreased to a minimum merely by eliminating the spacer 188 and replacing it with one or more ring springs. A lower but intermediate spring rate may be obtained by using a spacer 188 of lesser height and adding a lesser number of additional springs. A greater spring rate may be obtained by removing some of the ring springs 156, 158 and using a spacer 188 of increased height.

The spring chamber 16 is preferably filled with a lubricant to prolong the life of the spring assembly 18. Because the size of the spring chamber 16 changes during compression of the spring assembly 18, the lubricant necessarily periodically submerges the ball transfer mechanism 20 with manifestly good results. Preferably, lubricant is added to the jar 10 until the annulus between the barrel 12 and mandrel 14 is filled to a location above the anvil 138. In order to pressure balance the tool, a floater 190 is provided. The floater 190 is typically of annular construction providing a plurality of grooves 192 therein for receiving seal assemblies for sealing against the barrel 12 and mandrel 14. The clearances between the anvil 138 and barrel upper body 22 and between the hammer 142 and the mandrel upper body 124 are such as to allow free transfer of lubricant without substantial damping of movement between the barrel 12 and mandrel 14 after tripping of the ball transfer mechanism 20. To this end, one or more axially extending passageways may be provided through the anvil 138 and/or the hammer 142 as desired. In order to prevent the floater from passing over the top of the mandrel upper body 124, a keeper or retaining ring 194 is provided.

The ball transfer mechanism of this invention comprises a multiplicity of balls or spherical elements 196 carried in an annular sleeve or cage 198 which abuts the spring assembly 18. Also comprising part of the ball transfer mechanism 20 are the wear surfaces 54, 128 of the barrel 12 and mandrel 14 respectively.

In order to distribute the load acting on the ball transfer mechanism 20 and to prevent any single ball 196 from taking a great deal of load, there are at least three and preferably a much larger number of the balls 196. The number and size of the balls 196 is largely a direct function of the external diameter of the jar 10. This is one of those happy circumstances since larger diameter tools have larger load capacities which require more and larger balls 196. In typical tools sized for use in the open hole, the number of balls will vary in the range of about 6–12.

The sleeve 198 includes a lower section 200 abutting against the spring assembly 18, an upper section 202 having a plurality of openings 204 therein receiving the balls 196. The upper section 202 is of substantially reduced thickness as provided by a frustoconical surface 206. The spring assembly biases the carrier 198 in an upward direction to juxtapose the surfaces 54, 206. It will be evident, however, that upward movement of the carrier 198 is prevented by the balls 196 abutting the frustoconical wear surface 128 of the mandrel connecting section 106.

Figure 3:
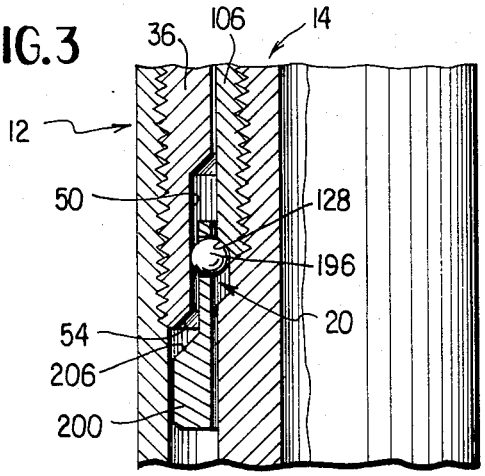
FIG. 3 is a broken section of the jar of FIG. 1 illustrating the trip mechanism at a time when the barrel is being pulled upward relative to the mandrel but before the trip mechanism releases the barrel and mandrel.
Figure 4:
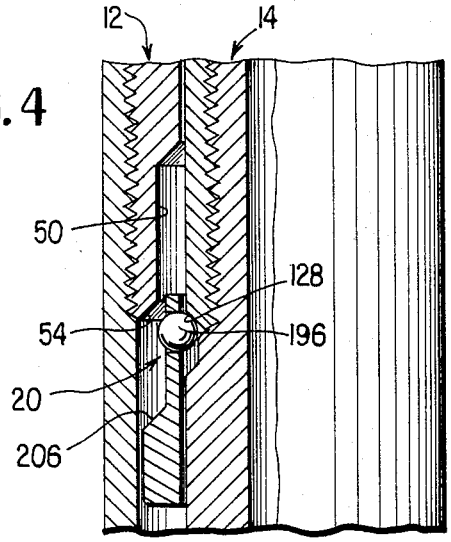
FIG. 4 is a view similar to FIG. 3 illustrating the trip mechanism immediately prior to release of the barrel relative to the mandrel.

Referring to FIGS. 2–4, operation of the ball transfer mechanism 20 of this invention is shown in greater detail. In FIG. 2, the jar 10 and the fishing string to which it is attached have been coupled to the fish. The fishing string is in the process of being manipulated by the drilling or workover rig (not shown) conducting the fishing operation. Specifically, the fishing string is being pulled upwardly by the drawworks thereby raising the barrel 12 relative to the mandrel 14. The spring assembly 18 is being compressed since the spacer 188 is moving upwardly relative to the lower section 200 of the carrier 198. The carrier 198 cannot move upwardly since the balls 196 are trapped by the wear surface 128 of the mandrel connecting section 106. Accordingly, the balls 196 move along the surface of the passage section 50 of the barrel connecting section 36 to space the surfaces 54, 206 apart.

In FIG. 3, the barrel 12 has moved upwardly a greater extent than in FIG. 2 to further compress the spring assembly 18. The barrel 12 has moved sufficiently relative to the mandrel 14 that the balls 196 have passed over the edge of the surface 50 onto the frustoconical wear surface 54. Since the balls 196 are illustrated as forced against the wear surface 128, FIG. 3 illustrates the relationship of the ball transfer mechanism 20 immediately prior to tripping, i.e. immediately prior to release of the barrel 12 for free independent movement relative to the mandrel 14. An additional increment of movement of the barrel 12 produces the relationship shown in FIG. 4 where the balls 196 have moved radially against the wear surface 54. At the position of FIG. 4, there is no mechanical interconnection between the barrel 12 and mandrel 14 or between the mandrel 14 and the spring assembly 18. Accordingly, the barrel 12 moves upwardly toward the position shown in FIG. 5 where the hammer 142 impacts the anvil 138 to produce an upward jar on the mandrel 14 which is transmitted through the grapple to the fish. The force moving the barrel 12 upwardly relative to the mandrel 14 is, of course, the tension imparted to the fishing string. The barrel 12 is thus yanked or pulled upwardly by the fishing string.

It should be noted that there is no spring acting directly on the balls 196 and the only spring force applied thereto is the force of the main spring assembly 18 acting through the carrier 198. The balls 196 are accordingly held in load supporting relation to the mandrel 14 because they are constrained against radial movement out of load supporting engagement by the surface of the passage section 50. During barrel movement, the constraint against radial movement of the balls 196 is removed, thereby allowing the balls 196 to move in whatever direction the forces acting thereon dictate. For example, in FIG. 4, the radial constraint against ball movement has been removed and the balls 196 are being pushed against the wear surface 54 to the same extent they are pushed against the wear surface 128. At this instant, it is theoretically just as easy for the balls 196 to remain in contact with the mandrel 14 as it is for the balls 196 to move out of contact with the mandrel 14. Accordingly, the balls 196 move out of load engagement with the mandrel 14 because the surfaces constraining the balls 196 against movement are removed rather than because the forces imposed on the balls 196 overcome some resilient resistance to the ball movement.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention.

I claim:

1. A jar comprising:

a barrel and a mandrel telescoped relative thereto and defining therebetween a spring chamber;

a spring in the spring chamber arranged to be stressed upon untelescoping movement between the barrel and the mandrel;

impact members carried by the barrel and mandrel for creating an impact force upon stressing of the spring and actuation of the jar;

a ball transfer mechanism operating between the barrel and mandrel for stressing the spring upon initial untelescoping movement of the barrel and mandrel and, after a predetermined untelescoping movement between the mandrel and barrel, for releasing the barrel and mandrel for free untelescoping movement to impact the members, the ball transfer mechanism including a plurality of balls and a carrier having a plurality of openings therein receiving the balls, the carrier having an end disposed in the spring chamber and abutting the spring for operatively connecting the carrier and the spring for biasing the carrier with the spring;

the spring being positioned to bias the carrier toward a location positioning the balls in latching engagement with the mandrel;

the barrel comprising a section providing a surface constraining the balls against radial movement for the duration of the preliminary untelescoping movement and then releasing the balls to enable radial movement thereof for unlatching the balls from the mandrel;

the mandrel comprising a notch having a frustoconical surface abutting the balls, a pair of bodies and a connecting section securing the mandrel bodies together and having a wear surface, the notch being provided in part by the wear surface, the mandrel connecting section being symmetrical about a plane perpendicular to a longitudinal tool axis to provide a second wear surface, the connecting section being invertible to present the second wear surface to the ball transfer mechanism.

2. A jar comprising a barrel and a mandrel telescoped relative thereto and defining therebetween a spring chamber;

a spring in the spring chamber arranged to be stressed upon untelescoping movement between the barrel and the mandrel;

impact members carried by the barrel and mandrel for creating an impact force upon stressing of the spring and actuation of the jar;

a ball transfer mechanism operating between the barrel and mandrel for stressing the spring upon initial untelescoping movement of the barrel and mandrel and, after a predetermined untelescoping movement between the mandrel and barrel, for releasing the barrel and mandrel for free untelescoping movement to impact the members, the ball transfer mechanism including a plurality of balls and a carrier having a plurality of openings therein receiving the balls, the carrier having an end disposed in the spring chamber and abutting the spring for operatively connecting the carrier and the spring for biasing the carrier with the spring;

the spring being positioned to bias the carrier toward a location positioning the balls in latching engagement with the mandrel;

the barrel comprising a section providing a surface constraining the balls against radial movement for the duration of the preliminary untelescoping movement and then releasing the balls to enable radial movement thereof for unlatching the balls from the mandrel;

the mandrel comprising a notch having a frustoconical surface abutting the balls, a pair of bodies and a connecting section securing the mandrel bodies together and having a wear surface, the notch being provided in part by the wear surface;

the barrel providing a wear surface and the ball transfer mechanism comprises means for transfering the balls from the mandrel wear surface to the barrel wear surface during release of the barrel and mandrel, the barrel comprising a pair of bodies and a connecting section securing the bodies together and providing the barrel wear surface, the barrel connecting section being symmetrical about a plane perpendicular to the longitudinal axis to provide a second barrel wear surface, the barrel connecting section being invertible to present the second barrel wear to the ball transfer mechanism.

3. The jar of claim 2 wherein the plane of barrel symmetry is coplanar with the plane of mandrel symmetry.

* * * * *